US008009107B2

(12) United States Patent
Li et al.

(10) Patent No.: US 8,009,107 B2
(45) Date of Patent: Aug. 30, 2011

(54) WIDEBAND DIELECTRIC ANTENNA

(75) Inventors: Qian Li, Ann Arbor, MI (US); Wladimiro Villarroel, Ypsilanti, MI (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 0 days.

(21) Appl. No.: 12/755,795

(22) Filed: Apr. 7, 2010

(65) Prior Publication Data

US 2010/0220031 A1 Sep. 2, 2010

Related U.S. Application Data

(63) Continuation-in-part of application No. 11/566,341, filed on Dec. 4, 2006, now abandoned.

(51) Int. Cl.
*H01Q 1/32* (2006.01)
*H01Q 1/38* (2006.01)

(52) U.S. Cl. ..... 343/700 MS; 343/713

(58) Field of Classification Search ..... 343/700 MS, 343/713, 711, 846, 848
See application file for complete search history.

(56) References Cited

U.S. PATENT DOCUMENTS

| | | | |
|---|---|---|---|
| 4,486,758 | A | 12/1984 | deRonde |
| 4,507,664 | A | 3/1985 | James et al. |
| 4,903,033 | A | 2/1990 | Tsao et al. |
| 4,914,445 | A | 4/1990 | Shoemaker |
| 5,155,493 | A | 10/1992 | Thursby et al. |
| 5,319,378 | A | 6/1994 | Nalbandian et al. |
| 5,497,164 | A | 3/1996 | Croq |
| 5,523,727 | A | 6/1996 | Shingyoji |
| 5,561,435 | A | 10/1996 | Nalbandian et al. |
| 5,633,645 | A | 5/1997 | Day |
| 5,767,810 | A | 6/1998 | Hagiwara et al. |
| 5,870,057 | A | 2/1999 | Evans et al. |
| 5,940,036 | A | 8/1999 | Oliver et al. |
| 5,945,950 | A | 8/1999 | Elbadawy |
| 5,959,581 | A | 9/1999 | Fusinski |
| 6,072,434 | A | 6/2000 | Papatheodorou |
| 6,191,740 | B1 | 2/2001 | Kates et al. |
| 6,297,774 | B1 | 10/2001 | Chung |
| 6,346,918 | B1 | 2/2002 | Munk |
| 6,452,559 | B1 | 9/2002 | Yuanzhu |
| 6,466,176 | B1 | 10/2002 | Maoz et al. |
| 6,538,609 | B2 | 3/2003 | Nguyen et al. |
| 6,661,386 | B1 | 12/2003 | Petros et al. |
| 6,924,774 | B2 | 8/2005 | Komatsu et al. |
| 6,995,709 | B2 | 2/2006 | Spittler |

(Continued)

FOREIGN PATENT DOCUMENTS

| | | |
|---|---|---|
| JP | 2000-232317 | 8/2000 |

(Continued)

*Primary Examiner* — Hoanganh Le
(74) *Attorney, Agent, or Firm* — Howard & Howard Attorneys PLLC

(57) ABSTRACT

An antenna for radiating an electromagnetic field having both linear and circular polarization includes a ground plane and a dielectric layer. The dielectric layer is disposed on the ground plane and has at least one exposed surface that radiates the electromagnetic field. A first feeding element is disposed on the exposed surface for electrically exciting the dielectric layer to provide the linear polarization at a first frequency having a first effective wavelength. A second feeding element is disposed on the exposed surface for electrically exciting the dielectric layer to provide the circular polarization at a second frequency having a second effective wavelength. The feeding elements are separated by a distance greater than ⅛ wavelength of the largest of the effective wavelengths.

20 Claims, 9 Drawing Sheets

U.S. PATENT DOCUMENTS

| | | | |
|---|---|---|---|
| 6,995,722 | B2 | 2/2006 | Komatsu et al. |
| 7,006,043 | B1 | 2/2006 | Nalbandian |
| 7,019,699 | B2 | 3/2006 | Komatsu et al. |
| 2001/0054978 | A1 | 12/2001 | Adachi et al. |
| 2002/0180646 | A1 | 12/2002 | Kivekas et al. |
| 2004/0041735 | A1 | 3/2004 | Sugimoto et al. |
| 2004/0160377 | A1 | 8/2004 | Aisenbrey |
| 2004/0169605 | A1 | 9/2004 | Komatsu et al. |
| 2005/0052334 | A1 | 3/2005 | Ogino et al. |
| 2005/0128161 | A1 | 6/2005 | Kagaya et al. |
| 2005/0146478 | A1 | 7/2005 | Wang et al. |
| 2005/0190106 | A1 | 9/2005 | Anguera Pros et al. |
| 2005/0195114 | A1 | 9/2005 | Yegin et al. |
| 2005/0259016 | A1 | 11/2005 | Yegin et al. |
| 2006/0097923 | A1 | 5/2006 | Li et al. |
| 2006/0109178 | A1 | 5/2006 | Takeuchi et al. |
| 2006/0145923 | A1 | 7/2006 | Autti |
| 2006/0232474 | A1 | 10/2006 | Fox |
| 2008/0129617 | A1 | 6/2008 | Li |
| 2008/0278378 | A1* | 11/2008 | Chang et al. ..... 343/700 MS |
| 2009/0102739 | A1* | 4/2009 | Chang et al. ..... 343/846 |

FOREIGN PATENT DOCUMENTS

| | | |
|---|---|---|
| JP | 2002-246837 | 8/2002 |
| JP | 2002-524954 | 8/2002 |
| JP | 2003-513495 | 4/2003 |
| JP | 2005-526436 | 9/2005 |
| JP | 2006-191644 | 7/2006 |
| JP | 2008-148304 | 8/2008 |
| WO | 2004/075343 A1 | 9/2004 |

* cited by examiner

FIG - 11
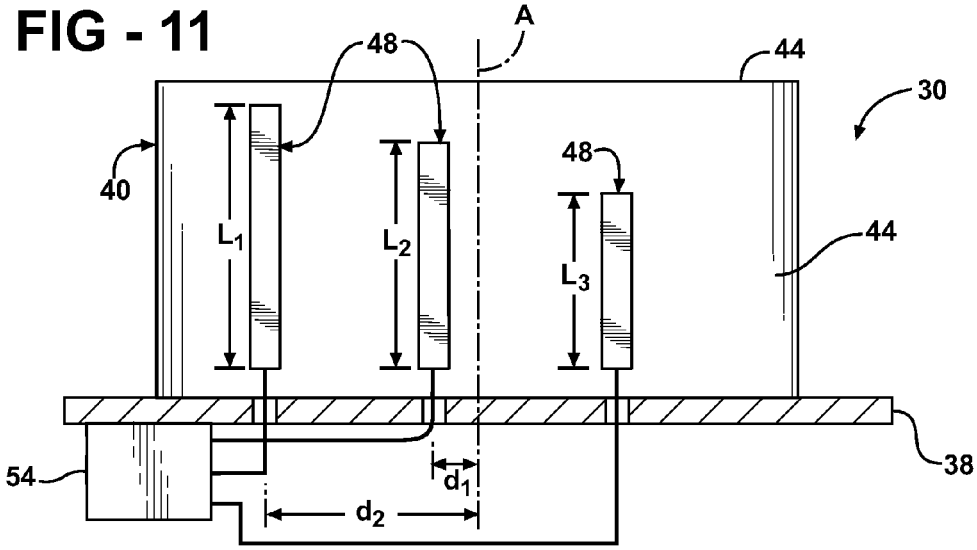
FIG - 12
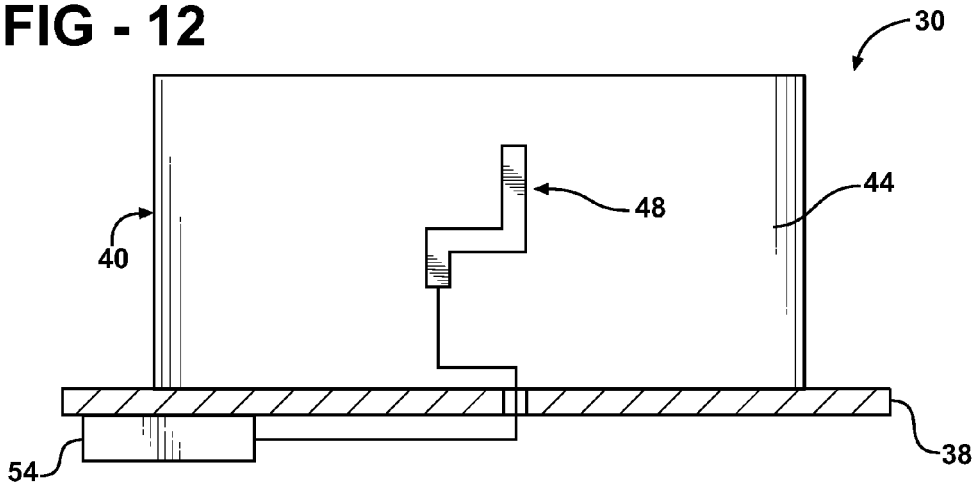
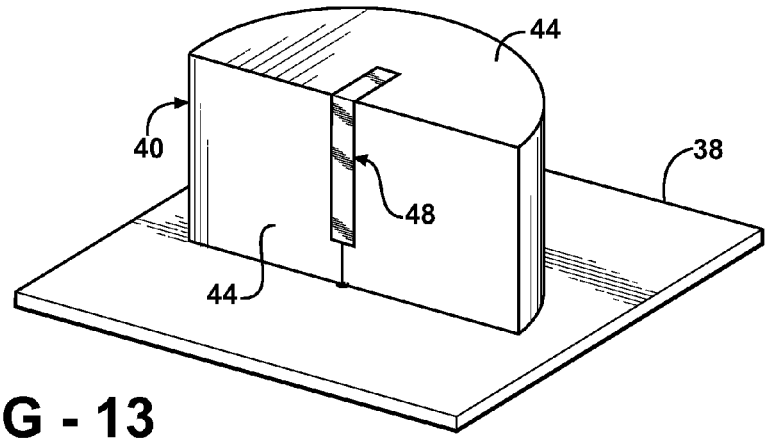
FIG - 13

WIDEBAND DIELECTRIC ANTENNA

CROSS-REFERENCES TO RELATED APPLICATIONS

This is a continuation-in-part application of application Ser. No. 11/566,341, filed Dec. 4, 2006.

BACKGROUND OF THE INVENTION

1. Field of the Invention

The present invention generally relates to an antenna for radiating an electromagnetic field from at least one radiating surface of a dielectric layer to achieve a desired polarization radiation.

2. Description of the Related Art

Various antennas for receiving circularly and/or linearly polarized RF signals are known in the art. In the antennas of the prior art, dielectric layers are typically used to isolate a radiation element, such as a discrete metal-based patch radiation element, from other elements of the antenna, such as a feeding probe and a ground plane. One example of such an antenna is disclosed in United States Patent Application Publication No. 2005/0195114 to Yegin et al. (the Yegin et al. publication). The Yegin et al. publication discloses an antenna mounted to a windshield of an automobile. The antenna includes a ground plane supporting dielectric layer. Further, the dielectric layer is supporting a metal layer having a slot, and the feeding probe excites the metal layer to radiate across the edges of the dielectric layer.

Although the antennas of the prior art can receive and/or transmit circularly and/or linearly polarized RF signals, there remains an opportunity to provide an antenna that maintains the ability to achieve circular and/or linear polarization radiation from all surfaces of the dielectric layer that extend transverse relative to the ground plane and are parallel to and spaced from the ground plane and maintain or improve the performance of the antenna, including increasing bandwidth, increasing efficiency, decreasing size and decreasing manufacturing complexity. Therefore, an antenna is needed that provides many desired characteristics that increase antenna performance when compared to the antennas of the prior art. In addition, an antenna is needed that may be used as a wideband antenna for multiple applications, including achieving any desired polarization radiation, such as providing both circular polarization and linear polarization. An antenna is needed that also has beam-tilting capabilities. Finally, an antenna is needed that is less sensitive and easier to tune when compared to the antennas of the prior art.

SUMMARY OF THE INVENTION AND ADVANTAGES

An antenna for radiating an electromagnetic field having both linear and circular polarization includes a ground plane and a dielectric layer. The dielectric layer is disposed on the ground plane and has at least one exposed surface that radiates the electromagnetic field. A first feeding element is disposed on the exposed surface for electrically exciting the dielectric layer to provide the linear polarization at a first frequency having a first effective wavelength. A second feeding element is disposed on the exposed surface for electrically exciting the dielectric layer to provide the circular polarization at a second frequency having a second effective wavelength. The feeding elements are separated by a distance greater than ⅛ wavelength of any of the effective wavelengths.

Disposing the feeding elements on the exposed surface of the dielectric layer electrically excites the dielectric layer such that the electromagnetic field radiates from the exposed surface. The separation of the feeding elements from one another assists in achieving both circular and linear polarized radiation without significant interference between the signals. Furthermore, the antenna has many desired performance characteristics. These characteristics include the antenna having a very wide frequency band, high efficiency, and minimum size. The wide frequency band allows the antenna to be used as a wideband antenna for multiple applications, including achieving both circular polarization and linear polarization. In addition, the electromagnetic radiation from the at least one exposed surface provides higher gain at lower elevation angles. Furthermore, disposing the feeding element on the dielectric layer having a non-symmetrical configuration allows for improved beam-tilted performance. This is desired in satellite radio applications. Moreover, disposing the feeding element on the at least one exposed surface results in the antenna being easier to tune and manufacture when compared to antennas of the prior art.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 11 is a partial cross-sectional side view of the antenna having a plurality of feeding elements disposed on one of the exposed surfaces of the dielectric layer;

FIG. 12 is a partial cross-sectional side view of the antenna having the feeding element extending in multiple directions;

FIG. 13 is a perspective view of the antenna having the feeding element extending from one of the exposed surfaces to another of the exposed surfaces of the dielectric layer;

DETAILED DESCRIPTION OF THE INVENTION

Referring to the Figures, wherein like numerals indicate corresponding parts throughout the several views, an antenna for radiating an electromagnetic field is shown generally at 30. In the illustrated embodiments, the antenna 30 is utilized to receive either one or both of a circularly polarized radio frequency (RF) signal or a linearly polarized RF signal. Those skilled in the art realize that the antenna 30 may also be used to transmit the circularly polarized and linearly polarized RF signal. Specifically, in some embodiments, the antenna 30 receives a left-hand circularly polarized (LHCP) RF signal like those produced by a Satellite Digital Audio Radio Service (SDARS) provider, such as XM® Satellite Radio or SIRIUS® Satellite Radio, a right-hand circularly polarized (RHCP) RF signal like those produced by GPS navigation systems, and a linearly polarized RF signals like those produced by cellular phone providers.

Figure 1:
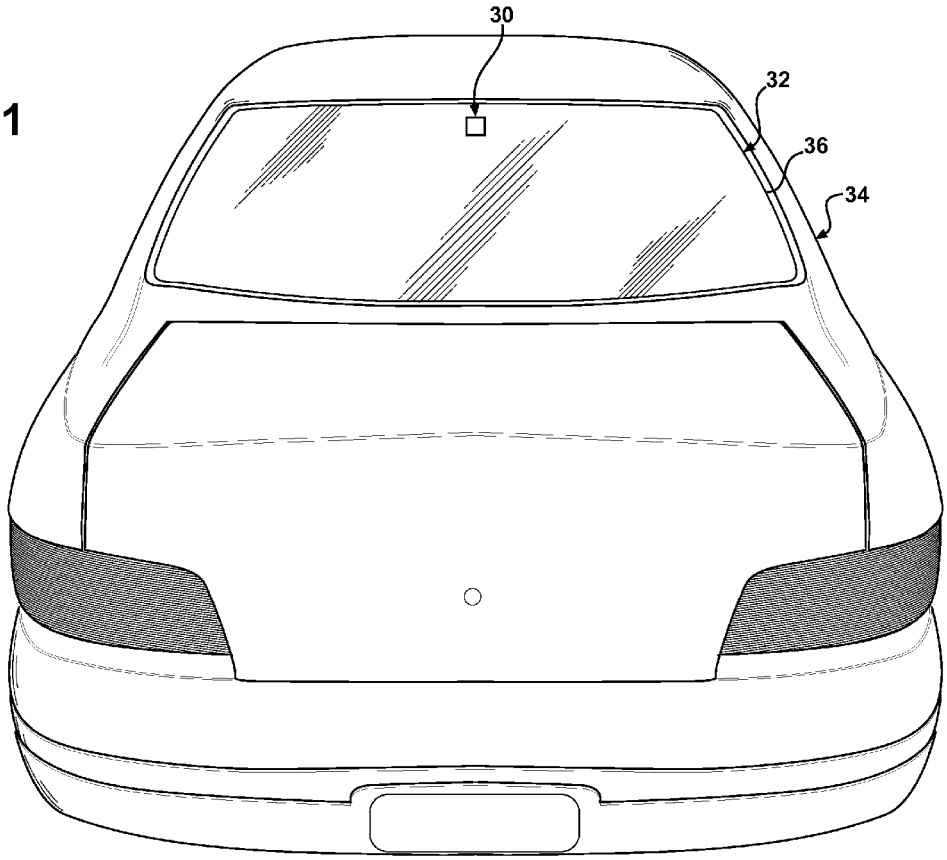
FIG. 1 is a perspective view of a vehicle with an antenna supported by a pane of glass of the vehicle.
Figure 2:
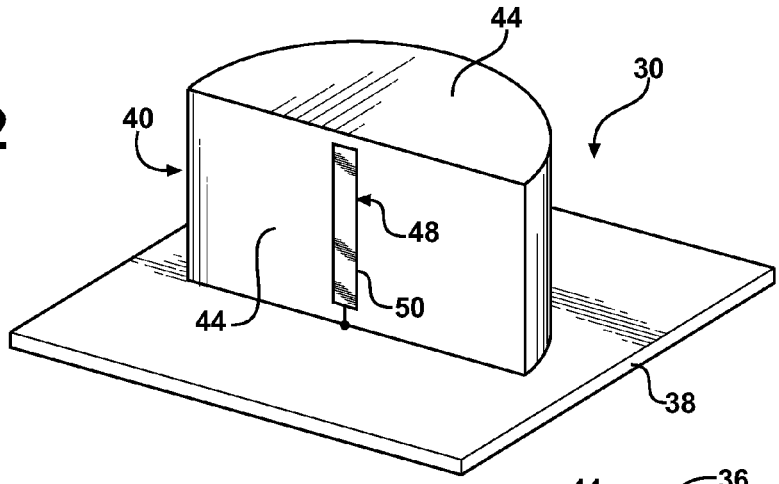
FIG. 2 is a perspective view of one embodiment of the antenna having a dielectric layer disposed on the ground plane and a feeding strip disposed on at least one exposed surface of the dielectric layer.
Figure 3:
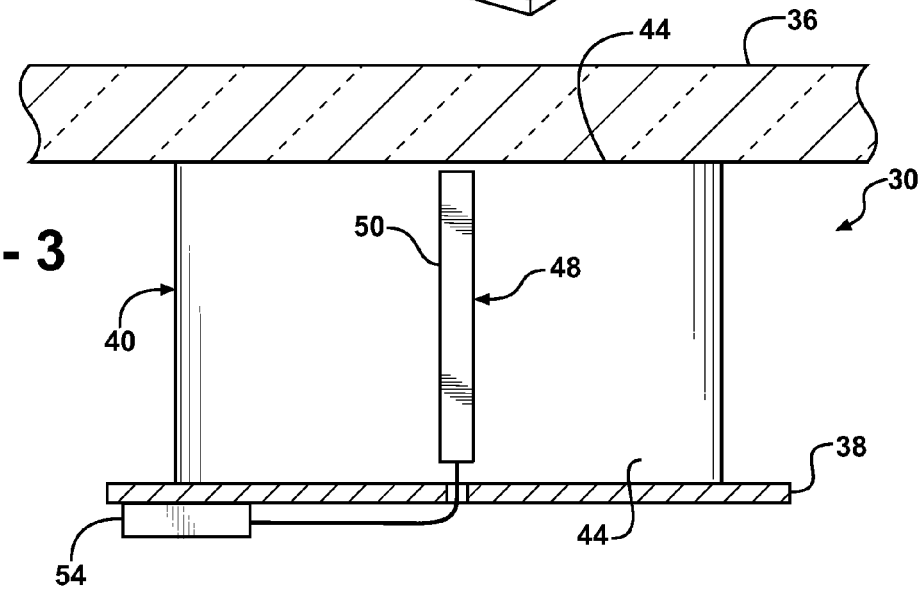
FIG. 3 is a partial cross-sectional side view of the antenna of FIG. 2 disposed on a nonconductive pane.
Figure 4:
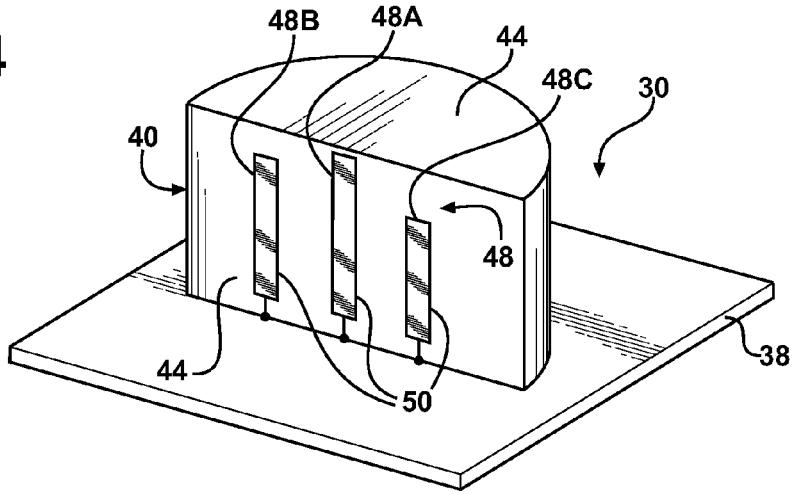
FIG. 4 is a perspective view of one embodiment of the antenna having a plurality of feeding strips disposed on one of the exposed surfaces of the dielectric layer.

Referring to FIG. 1, the antenna 30 is preferably integrated with a window 32 of a vehicle 34. The window 32 may be a rear window (backlite), a front window (windshield), or any other window of the vehicle 34. The antenna 30 may also be implemented in other situations completely separate from the vehicle 34, such as on a building or integrated with a radio receiver. Additionally, the antenna 30 may be disposed on other locations of the vehicle 34, such as on a side minor.

Multiple antennas 30 may be implemented as part of a diversity system of antennas. For instance, the vehicle 34 of the preferred embodiment may include a first antenna on the windshield and a second antenna on the backlite. Alternatively, the antennas 30 may be arranged in a stacked or side-by-side configuration. These antennas would both be electrically connected to a receiver (not shown) within the vehicle 34 via a transmission wire (not shown). Those skilled in the art realize several processing techniques may be used to achieve diversity reception. In one such technique, a switch (not shown) may be implemented to select the antenna 30 that is currently receiving a stronger RF signal from the satellite.

Preferably, the window 32 includes at least one nonconductive pane 36. The term "nonconductive" refers to a material, such as an insulator or dielectric, that when placed between conductors at different potentials, permits only a small or negligible current in phase with the applied voltage to flow through material. Typically, nonconductive materials have conductivities on the order of nanosiemens/meter.

In the illustrated embodiments, the nonconductive pane 36 is implemented as at least one pane of glass. Of course, the window 32 may include more than one pane of glass. Those skilled in the art realize that automotive windows 32, particularly windshields, may include two panes of glass sandwiching an adhesive interlayer. The adhesive interlayer may be a layer of polyvinyl butyral (PVB). Of course, other adhesive interlayers would also be acceptable. The nonconductive pane 36 is preferably automotive glass and more preferably soda-lime-silica glass. The pane of glass typically defines a thickness between 1.5 and 5.0 mm, preferably 3.1 mm. It is also typical for the pane of glass to have a relative permittivity between 5 and 9, preferably 7. Those skilled in the art, however, realize that the nonconductive pane 36 may be formed from plastic, fiberglass, or other suitable nonconductive materials. Furthermore, the nonconductive pane 36 functions as a radome for the antenna 30. That is, the nonconductive pane 36 protects the other components of the antenna 30 from moisture, wind, dust, etc. that are present outside the vehicle 34.

Referring generally to FIGS. 2-20, the antenna 30 includes a ground plane 38 for reflecting energy received by the antenna 30. As shown in FIGS. 3, 5, 7, and 9, the ground plane 38 is disposed substantially parallel to and spaced from the nonconductive pane 36 and is formed of a generally flat electrically conductive material like copper or aluminum having at least one planar surface. As shown in the Figures, the ground plane 38 generally defines a rectangular shape, and specifically a square shape. Accordingly, each side of the ground plane 38 may measure between 20 mm and 100 mm, and in a preferred embodiment 60 mm. However, those skilled in the art realize that other shapes and sizes of the ground plane 38 may be implemented.

The electromagnetic field is radiated by a dielectric layer 40 disposed on the ground plane 38. Specifically, as shown in FIGS. 3, 5, 7, and 9, the dielectric layer 40 is sandwiched between the ground plane 38 and the nonconductive pane 36. Here, the dielectric layer 40 radiates the electromagnetic field. However, in certain applications, the dielectric layer 40 may be integrated with portions of the nonconductive pane 36 such that the nonconductive pane 36 acts as the dielectric layer 40. This physically integrates the antenna 30 with the nonconductive pane 36, and thus, the window 32. In either case, the dielectric layer 40 radiates the electromagnetic field according to numerous physical properties. One of those properties is a relative permittivity. The dielectric layer 40 has a relative permittivity ($\in_r$) between 1 and 100. More specifically, in one embodiment, the relative permittivity is between 10 and 15. Even more specifically, in one embodiment, the relative permittivity is about 9.4. Another property of the dielectric layer 40 that influences the radiation of the electromagnetic field is the loss tangent. The dielectric layer 40 has a loss tangent between 0.001 and 0.03, and in one embodiment the loss tangent is 0.01. Additionally, the nonconductive pane 36 may operate in combination with the dielectric layer 40 to radiate the electromagnetic field.

As shown in the Figures, the dielectric layer 40 has at least one exposed surface 44 that radiates the electromagnetic field. Typically, the dielectric layer 40 has multiple exposed surfaces 44. Referring to FIGS. 3, 5, 7, and 9, the dielectric layer 40 is sandwiched between the ground plane 38 and the nonconductive pane 36 such that one of the exposed surfaces 44 abuts the nonconductive pane 36. In other words, one exposed surface 44 is generally parallel to and spaced from the ground plane 38. However, it should be understood that the dielectric layer 40 may include other exposed surfaces 44, and any or all of the exposed surfaces 44 may radiate. For instance, any surface not covered by the ground plane 38 is an exposed surface 44 and may radiate. Also, different exposed surfaces 44 may radiate differently. Although shown as planar surfaces in the Figures, at least one of or all of the exposed surfaces 44 may be curved. In other words, at least one of or all of the exposed surfaces 44 may have a semi-spherical configuration from a side view. Exciting the dielectric layer 40 causes the dielectric layer 40 to generate an electromagnetic field from the exposed surface 44.

The dielectric layer 40 defines an exterior perimeter and the exposed surface 44 may be any surface of the dielectric layer 40 that extends around the exterior perimeter of the dielectric layer 40. Specifically, any surface of the dielectric layer 40 may be the exposed surface 44 except for the surface of the dielectric layer 40 that faces and abuts the ground plane 38. Therefore, the exposed surface 44 is any surface of the dielectric layer 40 that is perpendicular to the ground plane 38 or parallel to and spaced from the ground plane 38. In other words, the exposed surface 44 may be any surface of the dielectric layer 40 that abuts the nonconductive pane 36, extends transverse relative to the ground plane 38, or extends parallel to and spaced from the ground plane 38. Accordingly, various surfaces of the dielectric layer 40 may define the exposed surface 44 so the dielectric layer 40 may include more than one exposed surface 44.

As discussed above, the exposed surface 44 is defined as any surface of the dielectric layer 40 that extends transverse relative to the ground plane 38 or as any surface that is parallel to and spaced from the ground plane 38. As such, any exposed surface 44 may radiate the electromagnetic field. Therefore, the dielectric layer 40 may include multiple exposed surfaces 44 and any number of the exposed surfaces 44 may radiate. Preferably, the dielectric layer 40 and the exposed surface 44 are integrally formed from a single material such that the relative permittivity between the dielectric layer 40 and the exposed surface 44 is uniform. In other words, it is preferred that the exposed surface 44 is part of the dielectric layer 40.

The dielectric layer 40 may have various configurations. For example, the dielectric layer 40 may be composed of a single material as discussed above. Alternatively, the dielectric layer 40 may be a combination of different materials having dielectric properties and various dimensions arranged in a stacked or side-by-side configuration to provide the antenna 30 with polarization radiation characteristics more suitable to particular applications, such as automotive applications.

As shown in FIGS. 2-15, the antenna 30 further includes at least one feeding element 48 disposed on at least one exposed surface 44 of the dielectric layer 40 for electrically exciting the dielectric layer 40 such that the electromagnetic field radiates from at least one exposed surface 44 and achieves a desired polarization radiation. If only one type of polarization radiation is desired, the antenna 30 may only include one feeding element 48 as shown in FIGS. 2-3, 6-7, 10, 12, and 13-14. However, if achieving different types of polarization radiation is desired, or the same type of polarization radiation for different applications is required, the antenna 30 may include multiple feeding elements 48 as shown in FIGS. 4, 5, 8, 9, 11, and 15. Specifically, one feeding element 48 disposed on the exposed surface 44 may achieve circular polarization, and another feeding element 48 disposed on the exposed surface 44 may achieve linear polarization.

In the embodiments illustrated by FIGS. 4, 5, 8, and 9, the dielectric layer 40 has a semi-cylindrial shape. That is, the dielectric layer 40 has a semi-circular cross-section. As such, one of the exposed surfaces 44 is substantially flat, rectangular shaped, and generally perpendicular to the ground plane 38. A first feeding element 48A is disposed on this rectangular exposed surface 44 to provide linear polarization at a first frequency. More specifically, the first feeding element 48A is disposed on a center axis A defined through a center of the rectangular exposed surface 44. Even more specifically, the first feeding element 48A provides linear polarization for cellular telephone reception and transmission. It will be appreciated that the term "frequency" as used herein may refer to a frequency band, i.e., a range or plurality of frequencies and/or a center frequency for a frequency band.

Also in the embodiments illustrated by FIGS. 4, 5, 8, and 9, a second feeding element 48B and a third feeding element 48C are disposed on the rectangular exposed surface 44 to provide circular polarization at a second frequency and a third frequency, respectively. Specifically, the second feeding element 48B provides circular polarization for SDARS reception and the third feeding element 48C provides circular polarization for GPS reception. More specifically, the second feeding element 48B is positioned offset to the center axis A to provide left-hand circular polarization (LHCP) while the third feeding element 48C is positioned offset to the center axis A, and opposite the second feeding element 48B, to provide right-hand circular polarization (RHCP). The first, second, and third frequencies are different in the illustrated embodiments. However, those skilled in the art realize that one or more of these frequencies may coincide.

As is well known to those skilled in the art, a free space wavelength ($\lambda$) of an RF signal is related to the frequency at which the RF signal operates. Furthermore, an effective wavelength ($\lambda_e$) depends on the permittivity of a dielectric material and corresponds to the free space wavelength ($\lambda$). Generally, the effective wavelength equals the free space wavelength divided by the square root of the relative permittivity ($\in_r$). In the illustrated embodiments, the feeding elements 48 are not disposed completely within the dielectric layer 40. As such, an actual effective wavelength does not follow this general rule precisely. Therefore, with a relative permittivity of about 9.4, the actual effective wavelength can be calculated by dividing the free space wavelength by a factor of around 2.5 to 2.8.

The length of each feeding element 48 is typically ¼ of the effective wavelength for the desired frequency. However, the length may vary from ⅛ to ½ of the effective wavelength. In the embodiments illustrated by FIGS. 4, 5, 8, and 9, the feeding elements 48 are separated from the center axis A by a distance of at least ⅛ of any of the effective wavelength of the desired frequencies. Preferably, the feeding elements 48 are separated from the center axis A by a distance of at least ⅛ of the largest effective wavelength of the desired frequencies.

The distance of the separation from the center axis A allows for the circular polarization to be generated without the assistance of hybrids or other phase shifting electronics. More specifically, for the applications described above, the second and third feeding elements 48B, 48C are separated by about 15 mm from the center axis A and the first feeding element 48A. Of course, the distance of separation will vary based on the desired frequency applications for the antenna 30 as well as other factors.

In one embodiment, the exposed surface 44 is further defined as a plurality of exposed surfaces 44 and the feeding element 48 is disposed on at least one of the plurality of exposed surfaces 44. In addition, another of the plurality of said exposed surfaces 44 may radiate the electromagnetic field. The different exposed surfaces 44 may radiate differently from one another, and the feeding element 48 may be disposed on any of the exposed surfaces 44. For instance, the feeding element 48 may be disposed on the exposed surface 44 that radiates. Alternatively, the dielectric layer 40 may include an exposed surface 44 that does not radiate. In this alternative, the feeding element 48 may be disposed on the exposed surface 44 that does not radiate while another exposed surface 44 does radiate.

Figure 15:
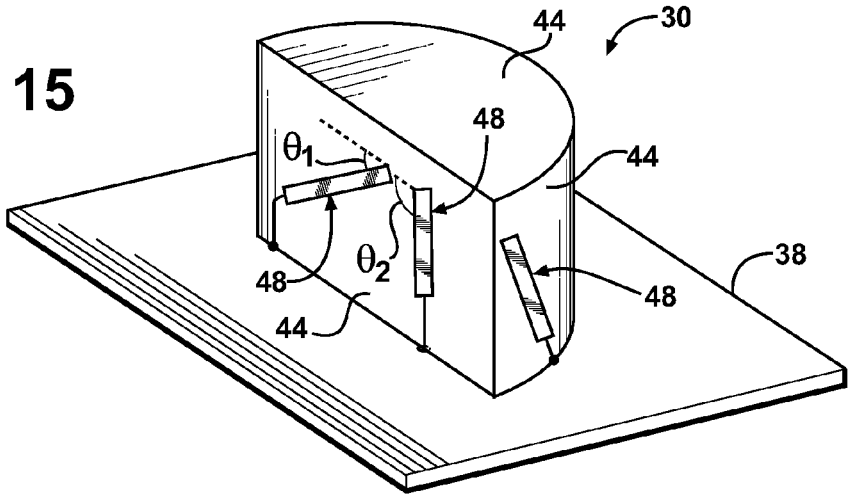
FIG. 15 is a perspective view of the antenna having multiple feeding elements disposed on one exposed surface and one feeding element disposed on another exposed surface of the dielectric layer.

As stated above, one feeding element 48 disposed on the exposed surface 44 may achieve left hand circular polarization, another feeding element 48 disposed on the exposed surface 44 may achieve right hand circular polarization, and yet another feeding element 48 disposed on the exposed surface 44 may achieve linear polarization. In either of these embodiments, the feeding elements 48 may be disposed on the same exposed surface 44 as shown in FIGS. 4-5, 8-9, and 11, or different exposed surfaces 44 as shown in FIG. 15. Likewise, two feeding elements 48 may be disposed on one exposed surface 44 and another feeding element 48 may be disposed on another exposed surface 44 as shown in FIG. 15. It is to be understood that any discussion of characteristics of multiple feeding elements 48 may also apply to the antenna 30 having a single feeding element 48 and that the antenna 30 of the subject invention is not limited to the antenna 30 having multiple feeding elements 48.

Whether the antenna 30 includes one feeding element 48 or multiple feeding elements 48, the individual feeding elements 48 are generally identical in composition. Generally, each feeding element 48 is an electrical conductor capable of exciting the dielectric layer 40 and is electrically isolated from the ground plane 38. Preferably, each feeding element 48 is formed from a metal. Although the feeding elements 48 may have a similar composition, certain physical characteristics of the feeding element 48 relative to the antenna 30, the exposed surfaces 44 of the dielectric layer 40 determine how the antenna 30 radiates the desired polarization radiation. For instance, the feeding element 48 has a uniform width "w" of 0.4 mm to 4 mm, and preferably, 1 mm to 3 mm. However, it is to be understood that the feeding element 48 may have a variable or non-uniform width. For example, the feeding element 48 may have a varied width between 0.4 mm and 4 mm.

Figure 14:
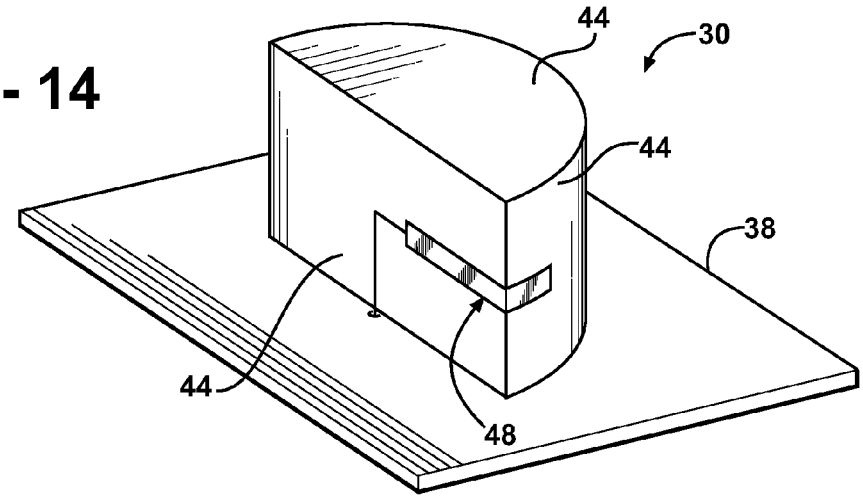
FIG. 14 is a perspective view of the antenna having the feeding element extending from one exposed surface to another exposed surface of the dielectric layer.

As shown in FIGS. 2-11, and 15, the feeding element 48 extends from the exposed surface 44 in a single direction, however, as shown in FIGS. 12-14, the feeding element 48 may extend in different directions. Likewise, the feeding element 48 may extend from one exposed surface 44 and onto another exposed surface 44 as shown in FIGS. 13 and 14. This applies whether the antenna 30 includes a single feeding element 48 or multiple feeding elements 48. In addition, referring now to FIGS. 10-11, and 15, the location and the orientation of the feeding element 48 on the exposed surface 44 relative to the radiating surface 42 affects how the antenna 30 radiates the desired polarization radiation. The length of the feeding element 48 affects the frequencies of radiation. The locations, angles, and lengths described below and shown in the Figures are merely exemplary and are not meant to be indicative of any particular desired polarization radiation.

Figure 10A:
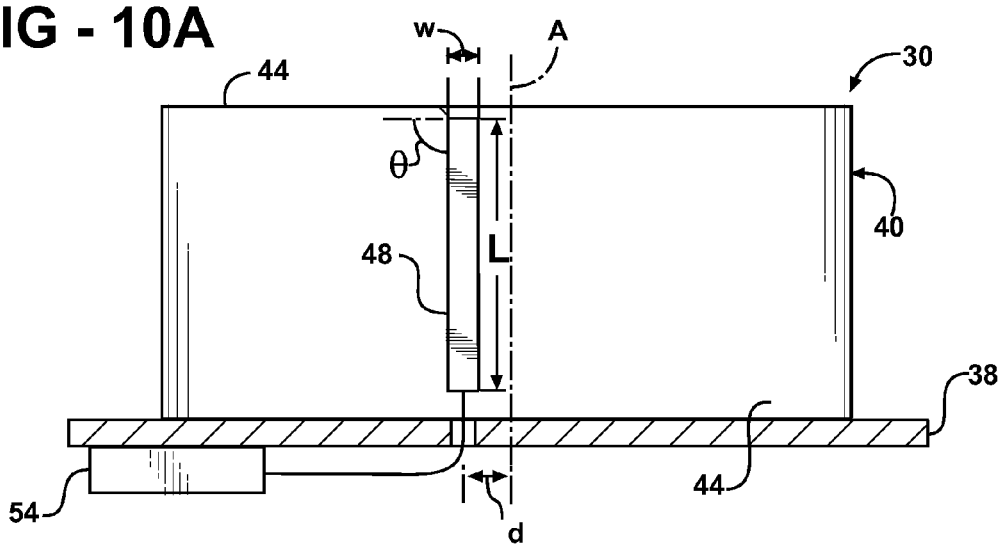
FIG. 10A is a partial cross-sectional side view of the antenna having the feeding element with a uniform width disposed on one of the exposed surfaces of the dielectric layer.
Figure 10B:
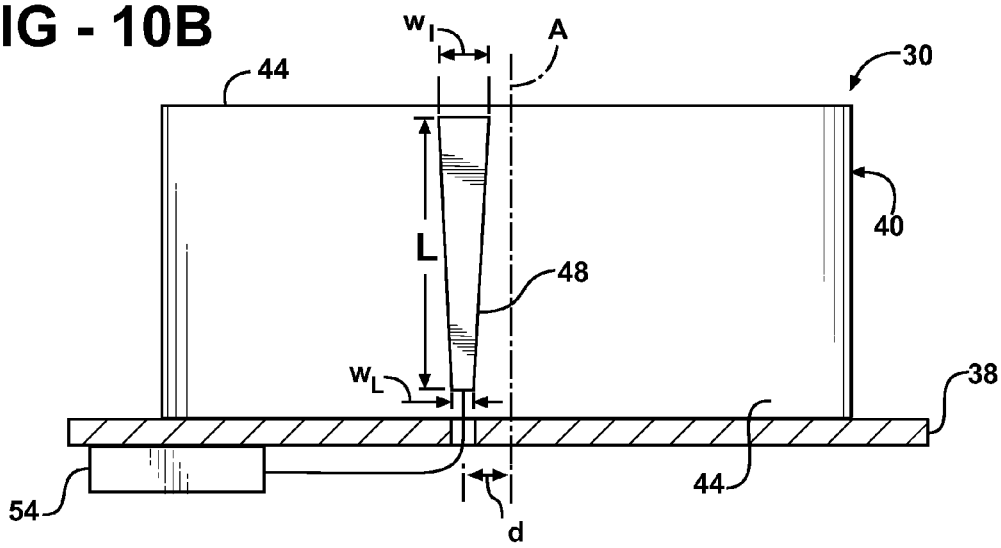
FIG. 10B is partial cross-sectional side view of the antenna having the feeding element with a non-uniform width disposed on one of the exposed surfaces of the dielectric layer.

Referring to FIGS. 10A and 10B, the feeding element 48 is disposed on the exposed surface 44 in a position "d" associated with at least one of circular polarization radiation and linear polarization radiation for achieving the desired polarization radiation. In the embodiment shown in FIG. 11, the antenna 30 includes multiple feeding elements 48 and a position d1 of one feeding element 48 is associated with circular polarization and a position d2 of another feeding element 48 is associated with linear polarization. The antenna 30 may include any number of feeding elements 48 having the location associated with either circular polarization or linear polarization. For instance, the antenna 30 may include two feeding elements 48 at a location associated with circular polarization and one feeding element 48 at a location associated with linear polarization. In order to determine the location of the feeding element 48 relative to the exposed surface 44, the exposed surface 44 defines the center axis A that extends through a center of the exposed surface 44 and, preferably, the feeding element 48 is offset from the center at a positioned 12 mm to 18 mm from the center axis "A" of the exposed surface 44 depending on the desired polarization radiation.

Referring to FIGS. 10A and 15, the feeding element 48 is oriented on the exposed surface 44 relative to the exposed surface 44 parallel to the ground plane at an angle θ associated with at least one of circular polarization radiation and linear polarization radiation for achieving the desired polarization radiation. In a preferred embodiment, the antenna 30 includes multiple feeding elements 48 and the angle $\theta_1$ of one feeding element 48 is associated with circular polarization and the angle $\theta_2$ of another feeding element 48 is associated with linear polarization. The antenna 30 may include any number of feeding elements 48 having the angle θ associated with either circular polarization or linear polarization. For instance, the antenna 30 may include two feeding elements 48 at an angle $\theta_1$ associated with circular polarization and one feeding element 48 at an angle $\theta_2$ associated with linear polarization. As shown in FIG. 10A, in one embodiment, the angle θ of the feeding element 48 relative to the ground plane 38 is 90 degrees. In other words, the feeding element 48 is perpendicular to the ground plane 38. Alternatively, as shown in FIG. 15, the feeding element 48 may be slanted at an angle θ relative to the ground plane 38 to achieve the desired polarization radiation.

As shown in FIGS. 10A and 10B, the feeding element 48 defines a length L and a width w. As stated above, the length L of the feeding element 48 affects the frequencies of radiation. The width w affects impedance matching of the antenna 30 to a transmission line (not shown). In FIG. 10A, the feeding element 48 has a uniform width. In FIG. 10B, the feeding element 48 has a non-uniform width. Referring now to FIG. 11, in a preferred embodiment, the antenna 30 includes multiple feeding elements 48 and the length $L_1$ of one feeding element 48 is associated with one center frequency of operation, the length $L_2$ of another feeding element 48 is associated with another center frequency of operation, and the length $L_3$ of yet another feeding element 48 is associated with yet another center frequency of operation. As previously discussed, the antenna 30 may include any number of feeding elements 48 having the length associated with any frequency of operation. Preferably, the length of each of the feeding elements 48 is between 10 mm to 20 mm.

Referring back to FIGS. 2-5, in one embodiment, the feeding element 48 may be further defined as a feeding strip 50. Accordingly, if the antenna 30 includes multiple feeding elements 48, the feeding element 48 is further defined as a plurality of feeding strips 50 spaced from one another on the exposed surface 44 of the dielectric layer 40 for electrically exciting the dielectric layer 40 such that the electromagnetic field radiates from the exposed surface 44. Alternatively, as shown in FIGS. 6-9, the feeding element 48 may be further defined as a feeding wire 52. Accordingly, if the antenna 30 includes multiple feeding elements 48, the feeding element 48 is further defined as a plurality of feeding wires 52 spaced from one another on the exposed surface 44 of the dielectric layer 40 for electrically exciting the dielectric layer 40 such that the electromagnetic field radiates from the exposed surface 44. In yet another embodiment, the feeding element 48 may include both the feeding strip 50 and the feeding wire 52.

Figure 5:
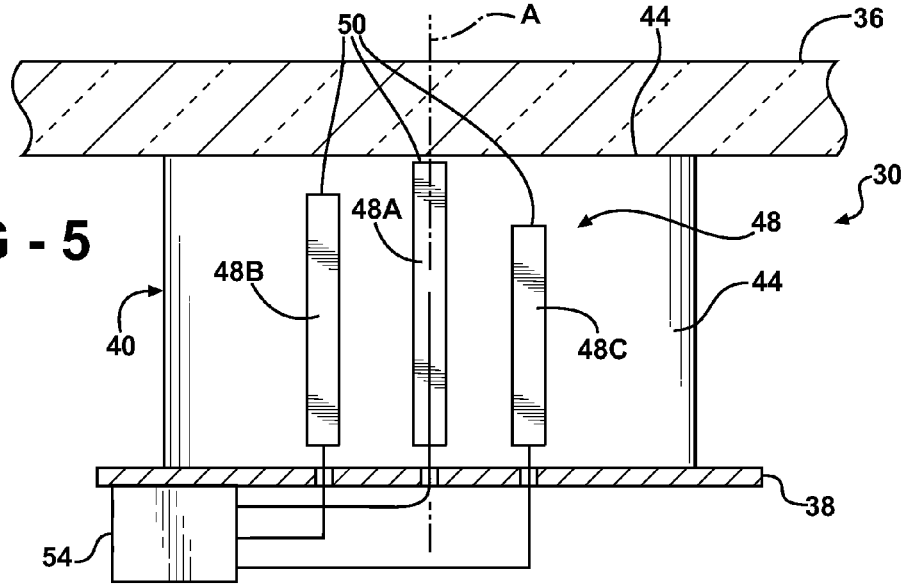
FIG. 5 is a partial cross-sectional side view of the antenna of FIG. 4 disposed on a nonconductive pane.
Figure 6:
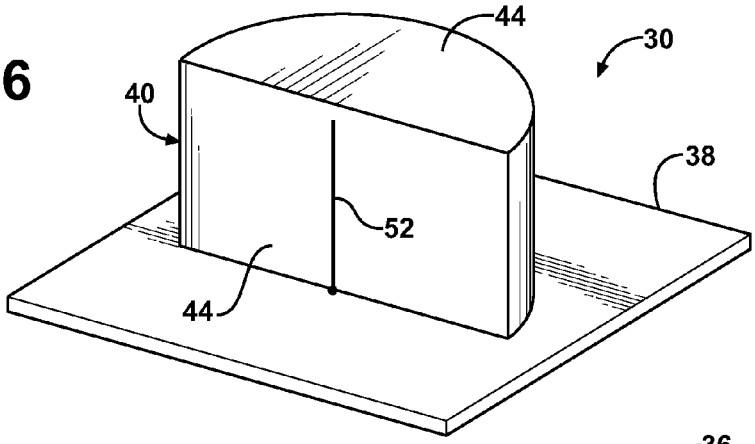
FIG. 6 is a perspective view of one embodiment of the antenna having the a feeding wire disposed on one of the exposed surfaces of the dielectric layer.
Figure 7:
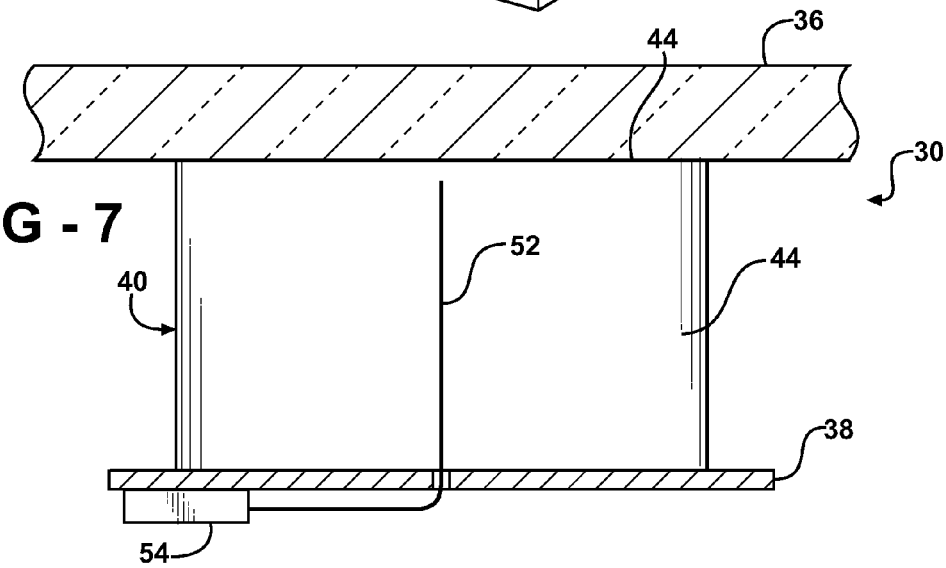
FIG. 7 is a partial cross-sectional side view of the antenna of FIG. 6 disposed on the nonconductive pane.
Figure 8:
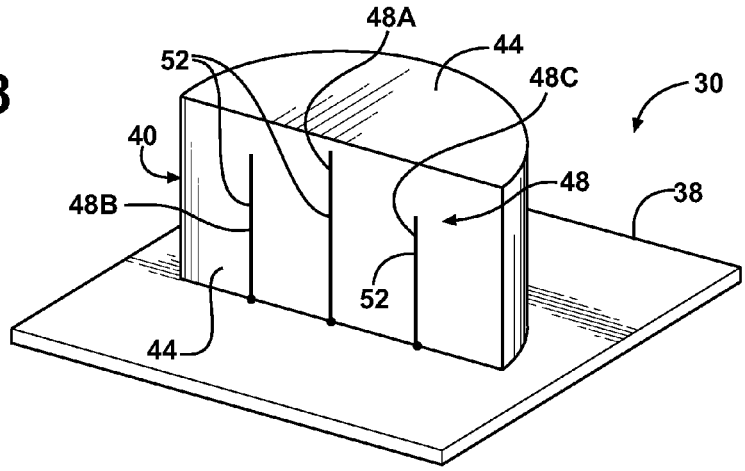
FIG. 8 is a perspective view of one embodiment of the antenna having a plurality of feeding wires disposed on one of the exposed surfaces of the dielectric layer.
Figure 9:
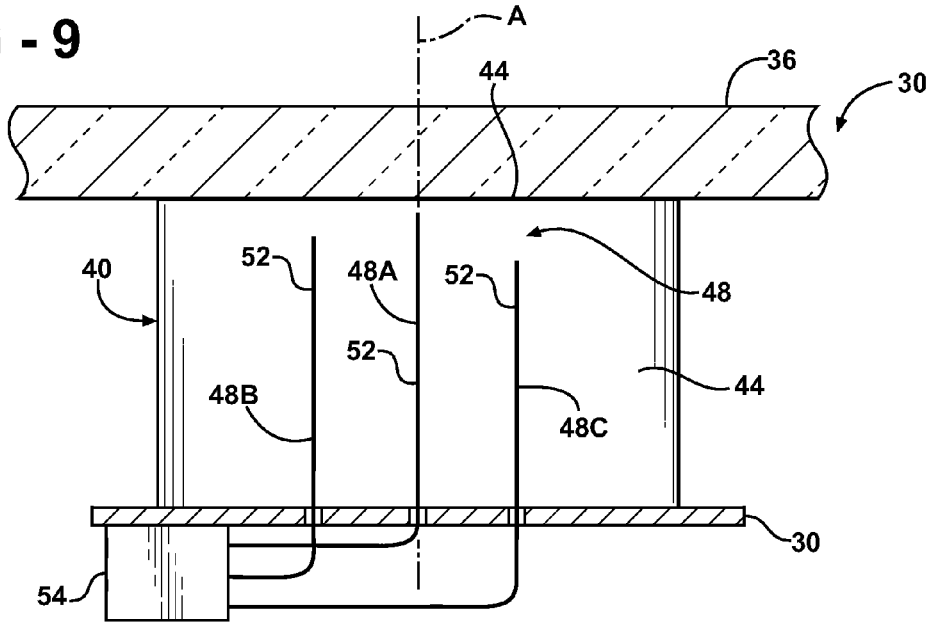
FIG. 9 is a partial cross-sectional side view of the antenna of FIG. 8 disposed on a nonconductive pane.

Regardless of which type of feeding element 48 is used, RF signals received by the antenna 30 are collected by the feeding element 48. As shown in FIGS. 3, 5, 7, and 9-12, the feeding element 48 transmits the RF signal to an amplifier 54 electrically connected to the feeding element 48 and grounded to the ground plane 38. The amplifier 54 amplifies the RF signal received by the antenna 30. Preferably, the amplifier 54 is a low noise amplifier (LNA) such as those known to those skilled in the art. As shown in FIGS. 5, 9, and 11, when multiple feeding elements 48 are used, each feeding element 48 may connect to one amplifier 54. Alternatively, the antenna 30 may have multiple amplifiers 54 similar to one another, and each amplifier 54 is connected to one of the feeding elements 48.

Figure 21:
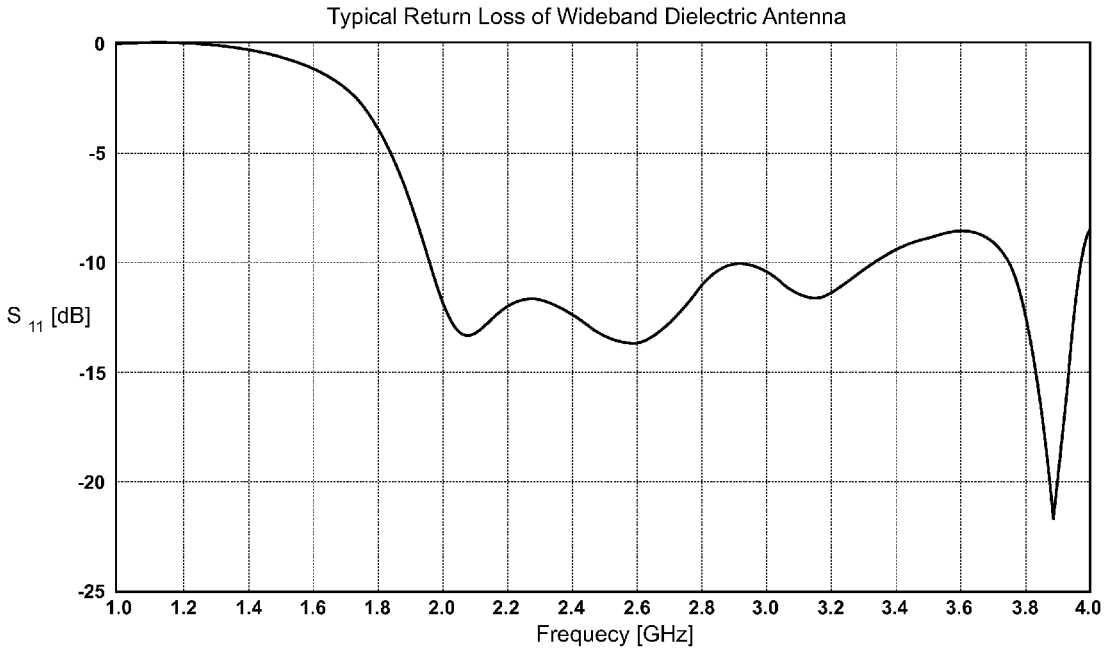
FIG. 21 is a graph showing a typical return loss of the antenna of the subject invention.

Disposing the feeding elements 48 on the exposed surface 44 of the dielectric layer 40 electrically excites the dielectric layer 40 such that the electromagnetic field radiates from the exposed surface 44 and achieves multiple polarization radiation. The antenna 30 of the subject invention therefore provides many desired characteristics that increase the performance of the antenna 30. These characteristics include the antenna 30 having a very wide frequency band, high efficiency, and decreased size, decreased manufacturing complexity, and decreased sensitivity. FIG. 21 is a graph showing a typical return loss of the antenna 30. According to this graph, the antenna 30 has a bandwidth that achieves an acceptable gain over about 70% of the desired center frequency, making the antenna 30 an ultra broadband antenna. A typical patch antenna achieves an acceptable gain over approximately 4% of the desired center frequency. Therefore, the antenna 30 provides a wider frequency band than patch antennas of the prior art. The wide frequency band allows the antenna 30 of the subject invention to be used as a wideband antenna for multiple applications, including achieving both circular polarization and linear polarization. In addition, the antenna 30 of the subject invention provides higher gain at lower elevation angles compared to typical patch antennas. This is desired in satellite radio applications. Furthermore, the various configurations of the dielectric layer 40 allow for improved beam-tilted performance. Likewise, the antenna 30 of the subject invention is less sensitive and easier to tune when compared to typical patch antennas of the prior art.

Figure 16:
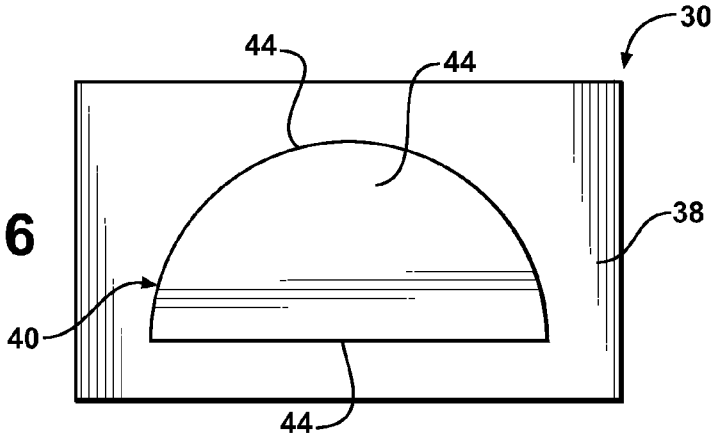
FIG. 16 is a top view of the dielectric layer having a semi-circular configuration.
Figure 17:
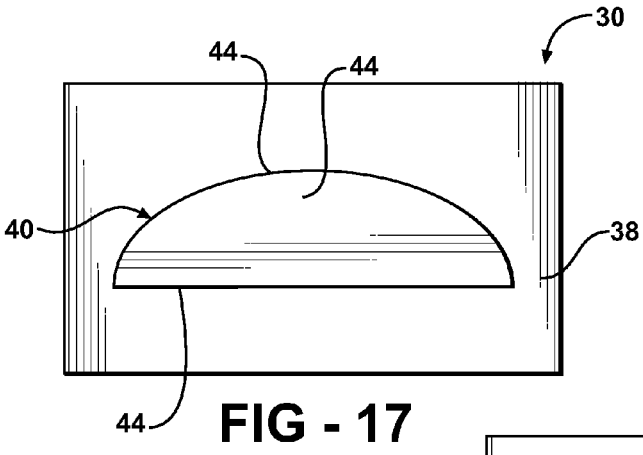
FIG. 17 is a top view of the dielectric layer having a semi-elliptical configuration.

Referring now to FIGS. 16-20, the dielectric layer 40 may have various shapes. In a preferred embodiment, as shown in FIG. 16, the dielectric layer 40 has a semi-circular configuration from a top view. Alternatively, as shown in FIG. 17, the dielectric layer 40 may have a semi-elliptical configuration from a top view. In these embodiments, the dielectric layer 40 includes at least three exposed surfaces 44 and at least one of the exposed surfaces 44 radiates. The dielectric layer 40 is plano-convex meaning that the dielectric layer 40 includes at least one planar surface opposite a surface having a convex curvature. Here, the surface having the convex curvature is one exposed surface 44 and the opposite planar surface is another exposed surface 44. In addition, the top surface may be the exposed surface 44. The feeding element 48 may be disposed on any of the exposed surfaces 44. At least one of the exposed surfaces 44 radiates. The feeding element 48 may be positioned partially on one of the exposed surfaces 44 and partially on another of the exposed surfaces 44.

Figure 18:
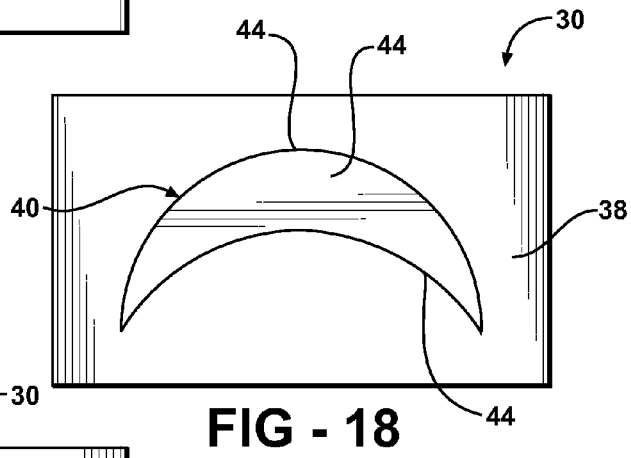
FIG. 18 is a top view of the dielectric layer having a crescent configuration.

Referring to FIG. 18, in another embodiment, the dielectric layer 40 has a crescent configuration from a top view. In this embodiment, the dielectric layer 40 has at least three exposed surfaces 44 and at least one of the exposed surfaces 44 radiates. The dielectric layer 40 includes a surface having a convex curvature opposite a surface having a concave curvature. A planar surface is perpendicular to the surface having the convex curvature and the surface having the concave curvature. The surface having the convex curvature, the surface having the concave curvature, and the planar surface are the exposed surfaces 44. The feeding element 48 may be positioned on either of the exposed surfaces 44. At least one of the exposed surface 44 radiates. As in the previous embodiments, the feeding element 48 may be positioned partially on one of the exposed surfaces 44 and partially on another of the exposed surfaces 44.

Figure 19:
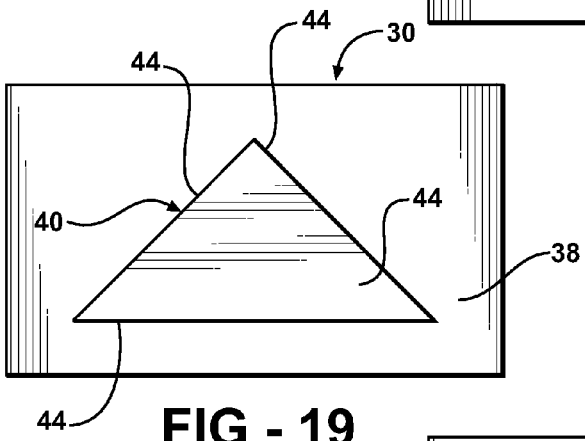
FIG. 19 is a top view of the dielectric layer having a triangular configuration.

Referring to FIG. 19, in yet another embodiment, the dielectric layer 40 has a triangular configuration from a top view. In this embodiment, the dielectric layer 40 has at least four exposed surfaces 44 and at least one of the exposed surfaces 44 radiates. The dielectric layer 40 includes three planar surfaces around the exterior perimeter of the dielectric layer 40. Any of the three planar surfaces may be the exposed surface 44. In addition, the dielectric layer 40 includes a surface perpendicular to the three planar surfaces. The surface perpendicular to the planar surfaces may also be the exposed surface 44. At least one of the exposed surfaces 44 radiates. As in the previous embodiments, the feeding element 48 may be positioned partially on one of the exposed surfaces 44 and partially on another of the exposed surfaces 44.

Figure 20:
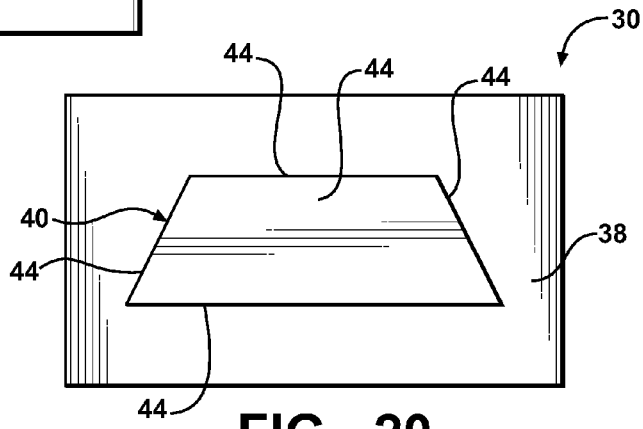
FIG. 20 is a top view of the dielectric layer having a trapezoidal configuration.

Referring to FIG. 20, in yet another embodiment, the dielectric layer 40 has a trapezoidal configuration from a top view. In this embodiment, the dielectric layer 40 has at least five exposed surfaces 44 and at least one of the exposed surfaces 44 radiates. The dielectric layer 40 includes four planar surfaces having various lengths around the exterior perimeter of the dielectric layer 40. Any of the four planar surfaces may be the exposed surface 44. In addition, the dielectric layer 40 includes a surface perpendicular to the four planar surfaces. The surface perpendicular to the four planar surfaces may be the exposed surface 44. At least one of the exposed surfaces 44 radiates. As in the previous embodiments, the feeding element 48 may be positioned partially on one of the exposed surfaces 44 and partially on another of the exposed surfaces 44.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention may be practiced otherwise than as specifically described.

What is claimed is:

1. An antenna for radiating an electromagnetic field having both linear and circular polarization, said antenna comprising:

a ground plane;

a dielectric layer disposed on said ground plane and having at least one exposed surface that radiates the electromagnetic field; and a first feeding element disposed on said at least one exposed surface for electrically exciting said dielectric layer to provide the linear polarization at a first frequency having a first effective wavelength; and a second feeding element disposed on said at least one exposed surface for electrically exciting said dielectric layer to provide the circular polarization at a second frequency having a second effective wavelength; wherein said feeding elements are separated by a distance greater than ⅛ wavelength of any of the effective wavelengths.

2. An antenna as set forth in claim 1 further comprising a third feeding element disposed on said exposed surface for electrically exciting said dielectric layer to provide the circular polarization at a third frequency having a third effective wavelength.

3. An antenna as set forth in claim 2 wherein said second feeding element is disposed opposite said first feeding element from said third feeding element and such that said second feeding element provides right hand circular polarization and said third feeding element provides left hand circular polarization.

4. An antenna as set forth in claim 1 wherein a center axis is disposed through a center of said exposed surface and said second feeding element is disposed offset from said center axis.

5. An antenna as set forth in claim 4 wherein the second feeding element is separated from the center axis by a distance greater than ⅛ wavelength of any of the effective wavelengths.

6. An antenna as set forth in claim 1 wherein said dielectric layer has a semi-circular configuration from a top view.

7. An antenna as set forth in claim 6 wherein said exposed surface is rectangular shaped, substantially flat, and extends transverse relative to said ground plane.

8. An antenna as set forth in claim 1 wherein said dielectric layer has a relative permittivity between 5 and 15.

9. An antenna as set forth in claim 1 wherein at least one of said feeding elements has a non-uniform width.

10. An antenna as set forth in claim 1 wherein said feeding elements define widths corresponding to an impedance for providing impedance matching with a transmission line.

11. A window having an integrated antenna for radiating an electromagnetic field having both linear and circular polarization, said window comprising:

a nonconductive pane;

a ground plane spaced from said nonconductive pane;

a dielectric layer sandwiched between said ground plane and said nonconductive pane and having at least one exposed surface that radiates the electromagnetic field;

a first feeding element disposed on said exposed surface for electrically exciting said dielectric layer to provide the linear polarization at a first frequency having a first effective wavelength; and a second feeding element disposed on said exposed surface for electrically exciting said dielectric layer to provide the circular polarization at a second frequency having a second effective wavelength; wherein said feeding elements are separated by a distance greater than ⅛ wavelength of any of the effective wavelengths.

12. A window as set forth in claim 11 further comprising a third feeding element disposed on said exposed surface for electrically exciting said dielectric layer to provide the circular polarization at a third frequency having a third effective wavelength.

13. A window as set forth in claim 12 wherein said second feeding element provides right hand circular polarization and said third feeding element provides left hand circular polarization.

14. A window as set forth in claim 11 wherein a center axis is disposed through a center of said exposed surface and said second feeding element is disposed offset from said center axis.

15. A window as set forth in claim 14 wherein the second feeding element is separated from the center axis by a distance greater than ⅛ wavelength of any of the effective wavelengths.

16. A window as set forth in claim 11 wherein said dielectric layer has a semi-circular configuration from a top view.

17. A window as set forth in claim 16 wherein said exposed surface is rectangular shaped, substantially flat, and extends transverse relative to said ground plane.

18. A window as set forth in claim 11 wherein said dielectric layer has a relative permittivity between 5 and 15.

19. A window as set forth in claim 11 wherein at least one of said feeding elements has a non-uniform width.

20. A window as set forth in claim 11 wherein said feeding elements define widths corresponding to an impedance for providing impedance matching with a transmission line.

* * * * *